US006068736A

United States Patent [19]

Graf

[11] Patent Number: 6,068,736

[45] Date of Patent: May 30, 2000

[54] SLICE LIP CLAMP ASSEMBLY FOR A SLICE LIP OF A HEADBOX

[75] Inventor: Edwin X. Graf, Menasha, Wis.

[73] Assignee: Voith Sulzer Paper Technology North America, Inc., Appleton, Wis.

[21] Appl. No.: 09/028,025

[22] Filed: Feb. 24, 1998

[51] Int. Cl.[7] ..... D21F 1/02

[52] U.S. Cl. ..... 162/344; 162/347

[58] Field of Search ..... 162/344, 336, 162/347

[56] References Cited

U.S. PATENT DOCUMENTS

| | | | |
|---|---|---|---|
| 4,221,635 | 9/1980 | Kurtz et al. | 162/344 |
| 4,326,916 | 4/1982 | Flaig et al. | 162/344 |
| 4,517,055 | 5/1985 | Dore | 162/344 |
| 4,517,056 | 5/1985 | Roerig et al. | 162/344 |
| 4,877,486 | 10/1989 | Kade et al. | 162/344 |
| 4,879,003 | 11/1989 | Reed | 162/344 |
| 5,560,808 | 10/1996 | Graf | 162/209 |
| 5,597,415 | 1/1997 | Graf | 118/123 |

*Primary Examiner*—Karen M. Hastings

*Attorney, Agent, or Firm*—Taylor & Aust, P.C.

[57] ABSTRACT

A headbox for a paper-making machine includes an inlet for receiving a fiber suspension. An apron and an upper wall converge relative to each other and define a machine wide discharge nozzle and an outlet therebetween. The discharge nozzle terminates at the outlet. A slice lip is carried by the upper wall. The slice lip is positioned at the outlet and includes a working edge defining an outlet gap with the apron. The slice lip is slidably movable a travel distance in directions toward and away from the outlet gap. A slice lip clamp assembly is connected to the upper wall. The slice lip clamp assembly engages the slice lip and biases the slice lip against the upper wall. The slice lip clamp assembly includes at least one clamping plate having at least one opening with an inside diameter, at least one fastener having an outside diameter and at least one keeper device. The inside diameter of each opening is larger than the outside diameter of each fastener by an amount which is dependent upon the travel distance. The at least one keeper device is positioned over each opening and has a number of through holes corresponding to the number of fasteners. Each fastener extends through a corresponding through hole and opening and is attached to the upper wall.

9 Claims, 4 Drawing Sheets

SLICE LIP CLAMP ASSEMBLY FOR A SLICE LIP OF A HEADBOX

BACKGROUND OF THE INVENTION

1. Field of the Invention

The present invention relates to paper-making machinery, and, more particularly, to a slice lip clamp assembly for a slice lip of a headbox.

2. Description of the Related Art

Paper-making machines typically include a headbox, including an inlet for receiving a fiber suspension and an outlet gap for discharging the fiber suspension with a known cross sectional profile onto a wire or forming fabric carried by a plurality of rolls. A slice lip is disposed at the outlet gap and is adjustable in a direction transverse to the outlet gap to thereby vary the outlet gap and control the discharge of the fiber suspension therefrom. A plurality of drive spindle assemblies may be spaced along the working length of the slice lip and deflect the slice lip in a direction transverse to the working edge. The slice lip may include a plurality of elongate openings extending downwardly from the top edge and in a direction transverse to the working edge of the slice lip for allowing increased local deformations of the slice lip by the drive spindle assemblies.

With conventional head boxes, a slice lip clamp assembly is used to position the slice lip relative to the outlet gap. The slice lip clamp assembly includes a plurality of clamping plates which are disposed side by side relative to each other across the working width of the slice lip. The clamping plates are rigidly fastened to the beam of the upper wall and substantially immovable relative to each other. Each rigidly mounted clamping plate is formed with a slot, with all of the slots being aligned relative to each other across the working width of the slice lip. An inflatable hose, such as a pneumatic hose, is received within the slots of the clamping plates. The pressure within the hose determines the clamping pressure on the slice lip. The slice lip is locally deflected using a relatively complicated arrangement of additional plates and hooked members which interconnect the spindles with the slice lip at corresponding locations across the working width of the slice lip. Although adequate for effecting local deformation and adjustment of the slice lip at the outlet gap, such known clamping plate assemblies are complicated and thus relatively expensive.

SUMMARY OF THE INVENTION

The present invention provides a slice lip clamp assembly having a plurality of clamping plates which are attached to an upper wall by fasteners which extend through respective openings in the clamping plates. The openings are larger than the fasteners by an amount which is dependent upon a travel distance of the slice lip toward and away from the outlet gap.

The invention comprises, in one form thereof, a headbox for a paper-making machine. The headbox includes an inlet for receiving a fiber suspension. An apron and an upper wall converge relative to each other and define a machine wide discharge nozzle and an outlet therebetween. The discharge nozzle terminates at the outlet. A slice lip is carried by the upper wall. The slice lip is positioned at the outlet and includes a working edge defining an outlet gap with the apron. The slice lip is slidably movable a travel distance in directions toward and away from the outlet gap. A slice lip clamp assembly is connected to the upper wall. The slice lip clamp assembly engages the slice lip and biases the slice lip against the upper wall. The slice lip clamp assembly includes at least one clamping plate having at least one opening with an inside diameter, at least one fastener having an outside diameter and at least one keeper device. The inside diameter of each opening is larger than the outside diameter of each fastener by an amount which is dependent upon the travel distance. The at least one keeper device is positioned over each opening and has a number of through holes corresponding to the number of fasteners. Each fastener extends through a corresponding through hole and opening and is attached to the upper wall.

An advantage of the present invention is that the slice lip clamp assembly is simplified in construction and less expensive than conventional slice lip clamp assemblies.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The embodiments set out herein illustrate one preferred embodiment of the invention, in one form, and such embodiments are not to be construed as limiting the scope of the invention in any manner.

DETAILED DESCRIPTION OF THE INVENTION

Figure 1:
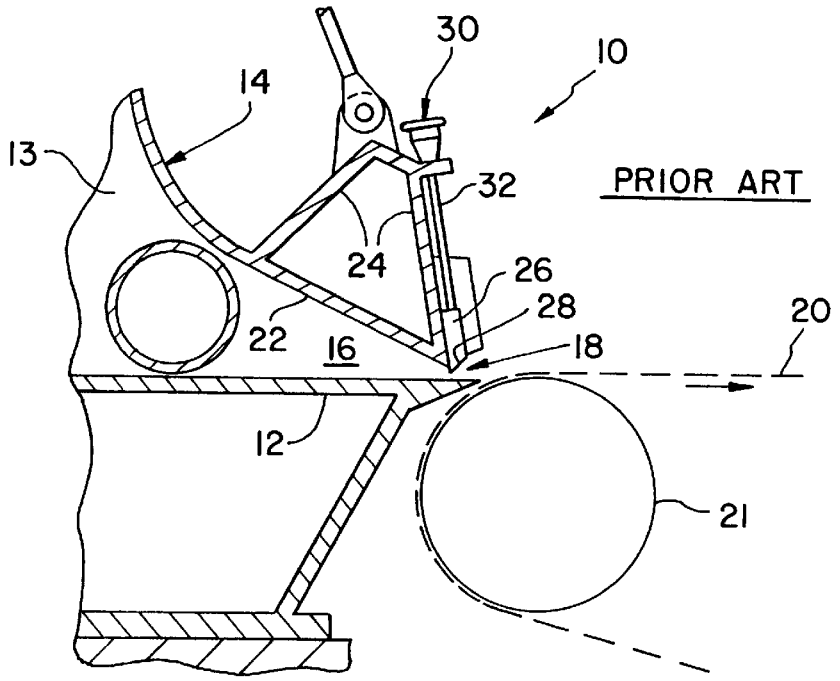
FIG. 1 is a side, sectional view of a conventional headbox including a slice lip.

Referring now to the drawings, and more particularly to FIG. 1, there is shown a portion of a conventional headbox 10 including an inlet (not shown) for receiving a fiber suspension and an outlet defining an outlet gap for discharging the fiber suspension. Headbox 10 has a plurality of walls, including an apron 12 and a pair of side plates, one of which is referenced 13. Side plates 13 are disposed at opposite ends of headbox 10. Apron 12 and upper wall 14 converge relative to each other and define a nozzle-type, machine wide stock channel 16 which ends in a machine wide outlet gap 18. The fiber suspension is discharged from outlet gap 18 in known manner onto a wire or forming fabric 20 carried by a breast roll 21. Upper wall 14 includes an upper flow guide wall 22 and a beam 24. To avoid thermal deformations of upper flow guide wall 22 and beam 24, a liquid may be circulated through internal channels (not shown) formed in beam 24, thereby maintaining beam 24 in a substantially isothermal state. A lift device (not shown) is attached to upper wall 14 for pivotally moving upper wall 14 relative to apron 12. Upper wall 14 is thus movable relative to apron 12.

Slice lip 26 is carried by beam 24 and is positioned at the outlet of headbox 10. More particularly, slice lip 26 includes a working edge 28 which with apron 12 defines outlet gap 18 extending across the width of headbox 10.

Figure 2:
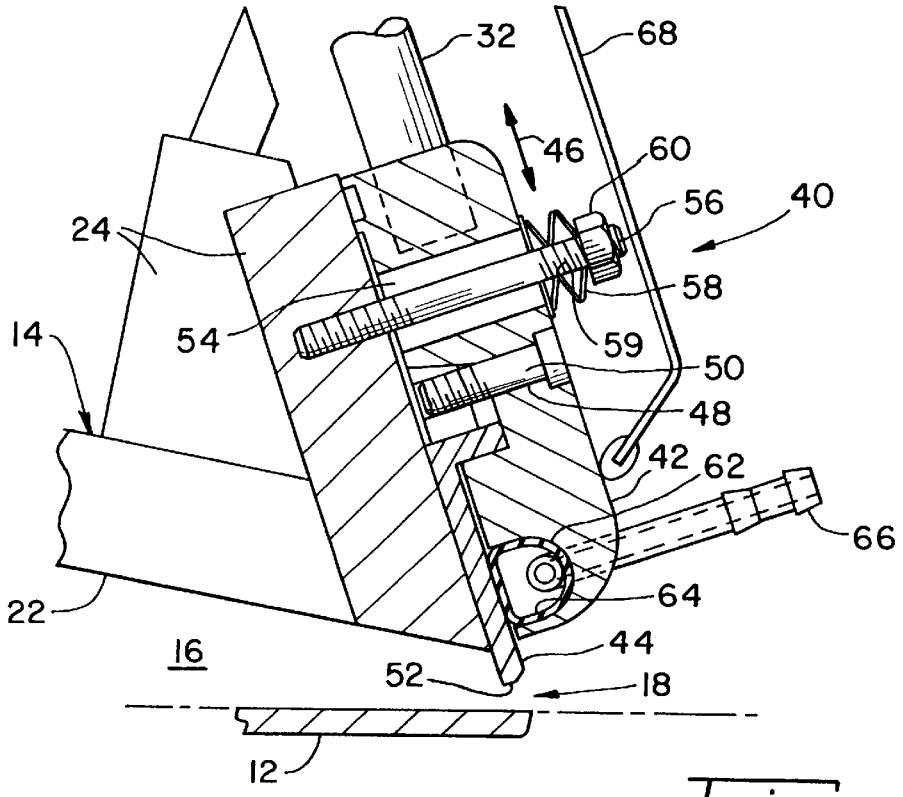
FIG. 2 is a fragmentary, side, sectional view of one embodiment of a slice lip clamp assembly of the present invention.

A plurality of spindle drive assemblies 30 are disposed in spaced apart relationship relative to each other and across the working length of slice lip 26. Spindle drive assemblies 30, one of which is shown in FIGS. 1 and 2, effect the fine adjustment of outlet gap 18. Each spindle drive assembly 30 includes a spindle drive at its upper end (not shown) which rotatably drives an adjustment spindle 32 which is connected with slice lip 26.

Figure 3:
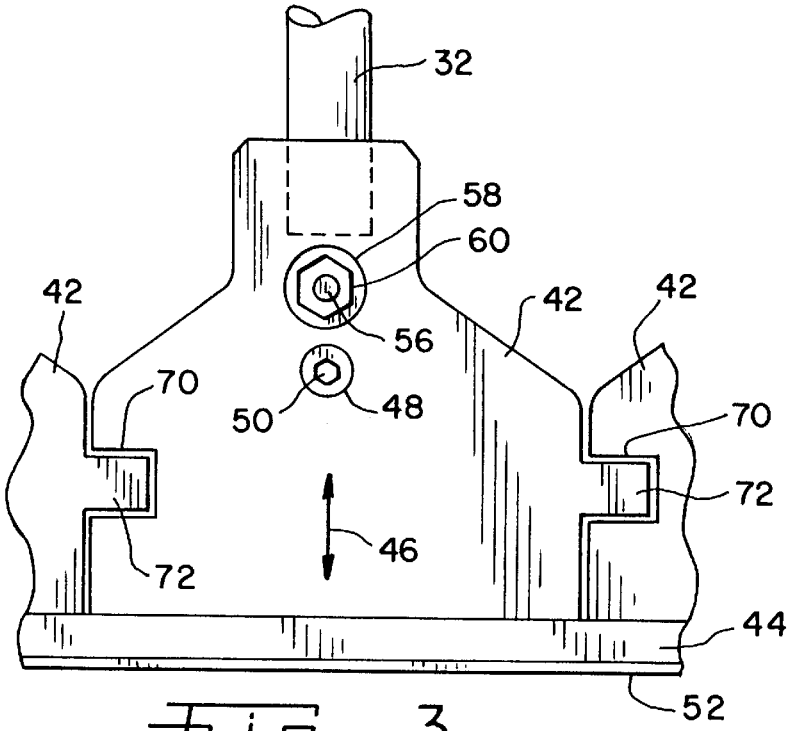
FIG. 3 is a fragmentary, plan view of the slice lip clamp assembly shown in FIG. 2.

Referring now to FIGS. 2–3, there is a shown an embodiment of a slice lip clamp assembly 40 of the present invention. Slice lip clamp assembly 40 includes a plurality of substantially identical clamping plates 42 which are arranged side by side relative to each other across the working width of a slice lip 44. Each clamping plate 42 is slidably connected with beam 24 of upper wall 14, as indicated by double headed arrow 46, and biases slice lip 44 against beam 24. More particularly, each clamping plate 42 includes an aperture 48 therein. A bolt 50 extends through aperture 48 and attaches the corresponding clamping plate 42 with slice lip 44. Each clamping plate 42 is thus separately and independently attached to slice lip 44, thereby enabling local adjustment of a working edge 52 of slice lip 44.

Each clamping plate 42 also includes an opening 54 having an inside diameter (not numbered). A corresponding fastener in the form of a threaded stud 56 passes through opening 54 and connects clamping plate 42 with beam 24 in a slidably movable manner. To wit, a plurality of keeper devices in the form of axially compressible washers 58 (such as Bellville (TM) washers) are placed over each respective bolt 56 and overlie a corresponding opening 54. Each washer 58 includes a through hole 59 which allows washer 58 to be placed over and around bolt 56. Washer 58 has an outside diameter which is larger than the inside diameter of opening 54. One end of bolt 56 is threaded into beam 24, and the opposing end receives a threaded nut 60. Nut 60 may be, e.g., a lock nut which is tightened a predetermined amount against washer 58, such that a desired preload is placed against clamping plate 42. By changing the preload against clamping plate 42, the frictional resistance between clamping plate 42 and each of beam 24 and washer 58 may be varied, thereby varying the amount of force which is required to slidably move clamping plate 42 in one of two opposite directions 46 using a spindle 32.

The inside diameter of opening 54 is sized to be larger than the outside diameter of bolt 56 by an amount which is dependent upon a maximum travel distance of slice lip 44 in opposite directions 46. More particularly, the difference between the inside diameter of opening 54 and the outside diameter of bolt 56 is selected such that slice lip 44 may be moved in opposite directions 46 a desired maximum travel distance toward and away from outlet gap 18.

Each clamping plate 42 additionally includes a slot 62 extending in a direction of the working width of slice lip 44. The slots 62 of each clamping plate 42 are aligned with each other and receive a loading tube 64 therein. Loading tube 64 may be connected with an external source of pressurized fluid, such as a source of pressurized air (not shown), using a barbed fitting 66 or other suitable fluid connector. A cover 68 overlies a portion of each of the plurality of clamping plates 42 and prevents fiber stock and other matter from accumulating to an appreciable extent on slice lip clamp assembly 40.

Each clamping plate 42 further includes a plurality of travel limiting elements which limit the travel distance of slice lip 44 in directions 46 toward and away from outlet gap 18. In the embodiment shown, each clamping plate 42 includes a first travel limiting element in the form of a recess 70 and a second travel limiting element in the form of a projection 72. Recess 70 and projection 72 are disposed on opposing side edges of clamping plate 42 and limit the travel distance of clamping plate 42 in opposing directions 46 toward and away from outlet gap 18. More particularly, each clamping plate 42 includes a projection 72 which fits within and thereby mates with a corresponding recess 70 of an adjacent clamping plate 42. The clearance distance between projection 72 and recess 70 in the opposing directions 46 limits the amount of local adjustment of an individual clamping plate 42. That is, a particular clamping plate 42 may only be moved in a direction toward or away from outlet gap 18 until its recess 70 or projection 72 contacts a corresponding surface of an adjacent clamping plate 42. In this manner, the local deformation of slice lip 44 from one clamping plate 42 to an adjacent clamping plate 42 can be controlled to prevent permanent deformation of slice lip 44. It will thus be appreciated that the difference between the inside diameter of opening 54 and the outside diameter of bolt 56 is not only a function of a desired maximum travel distance of slice lip 44, but also may be a function of the maximum travel distance associated with travel limiting elements 70 and 72.

Figure 4:
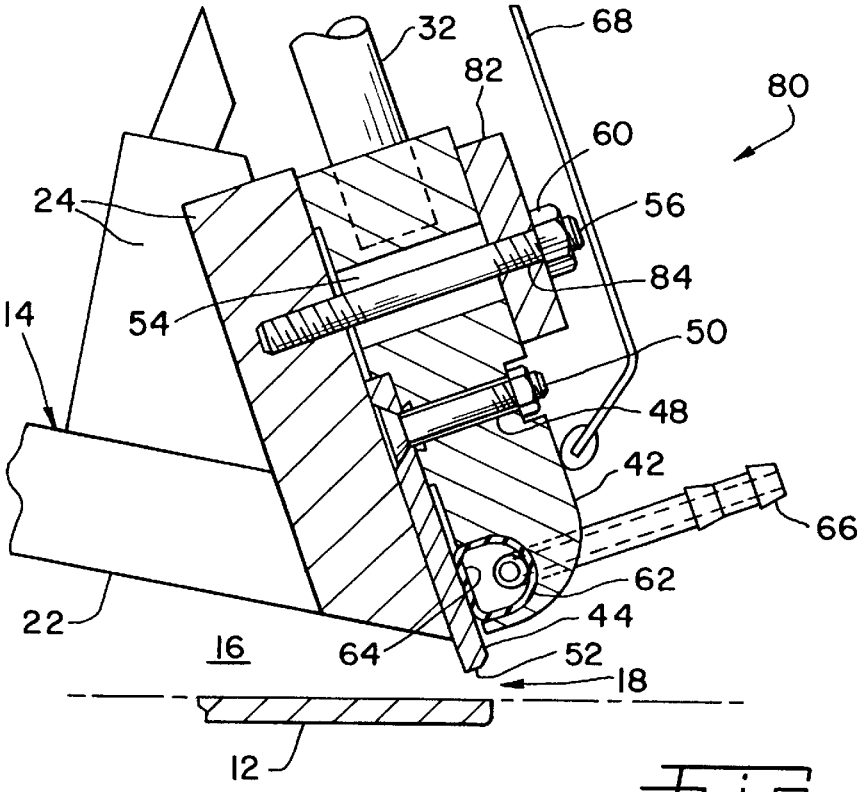
FIG. 4 is a fragmentary, side, sectional view of another embodiment of a slice lip clamp assembly of the present invention.
Figure 5:
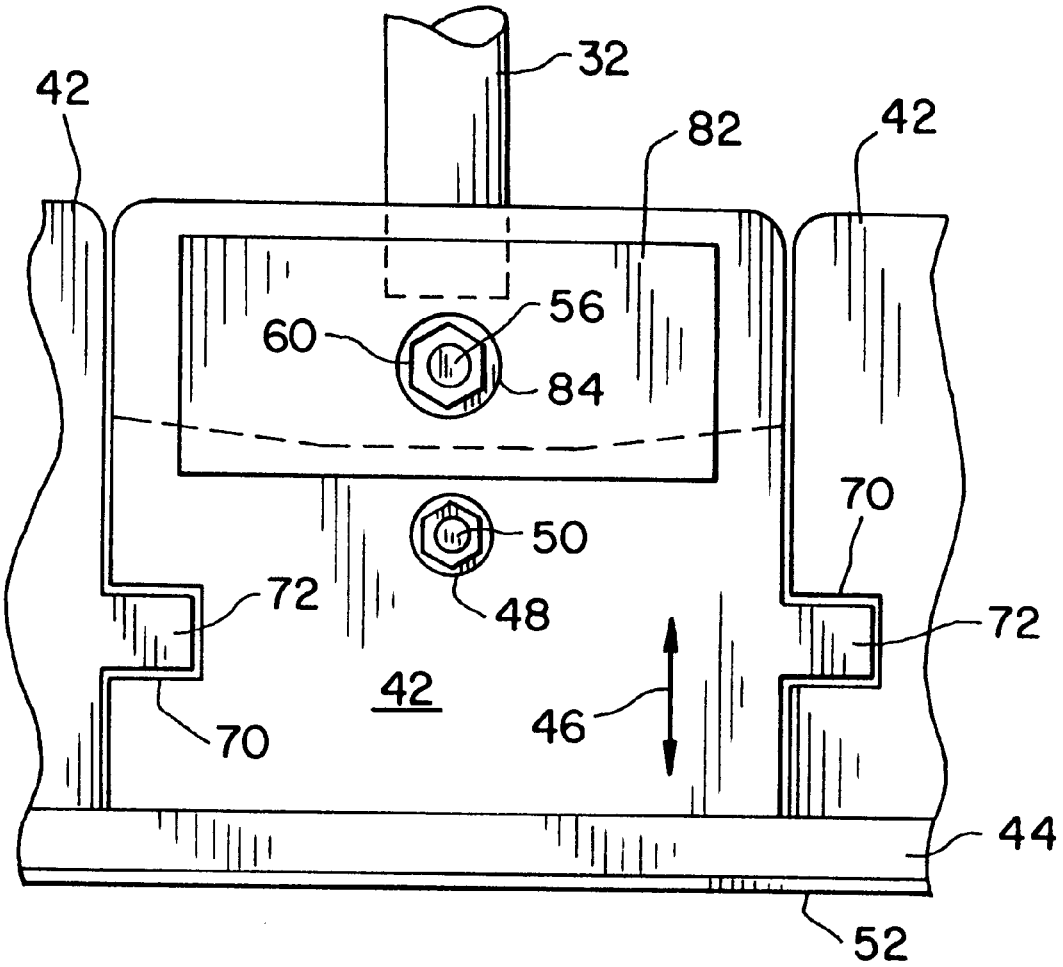
FIG. 5 is a fragmentary, plan view of the slice lip clamp assembly shown in FIG. 4.

Referring now to FIGS. 4 and 5, another embodiment of a slice lip clamp assembly 80 of the present invention is shown. Slice lip clamp assembly 80 is similar to slice lip clamp assembly 40 shown in FIGS. 2 and 3 in many respects. A primary distinction between clamp assembly 80 shown in FIGS. 4 and 5 and clamp assembly 40 shown in FIGS. 2 and 3 is that each clamping plate 42 of slice lip clamp assembly 80 is engaged by a plate 82, rather than an axially compressible washer 58. More particularly, each clamping plate 42 is engaged by a corresponding plate 82 having a through hole 84 therein. Bolt 56 extends through each of opening 54 and through hole 84. Threaded nut 60 may be tightened to a desired amount to provided a desired preload between clamping plate 42 and each of beam 24 and plate 82.

Figure 6:
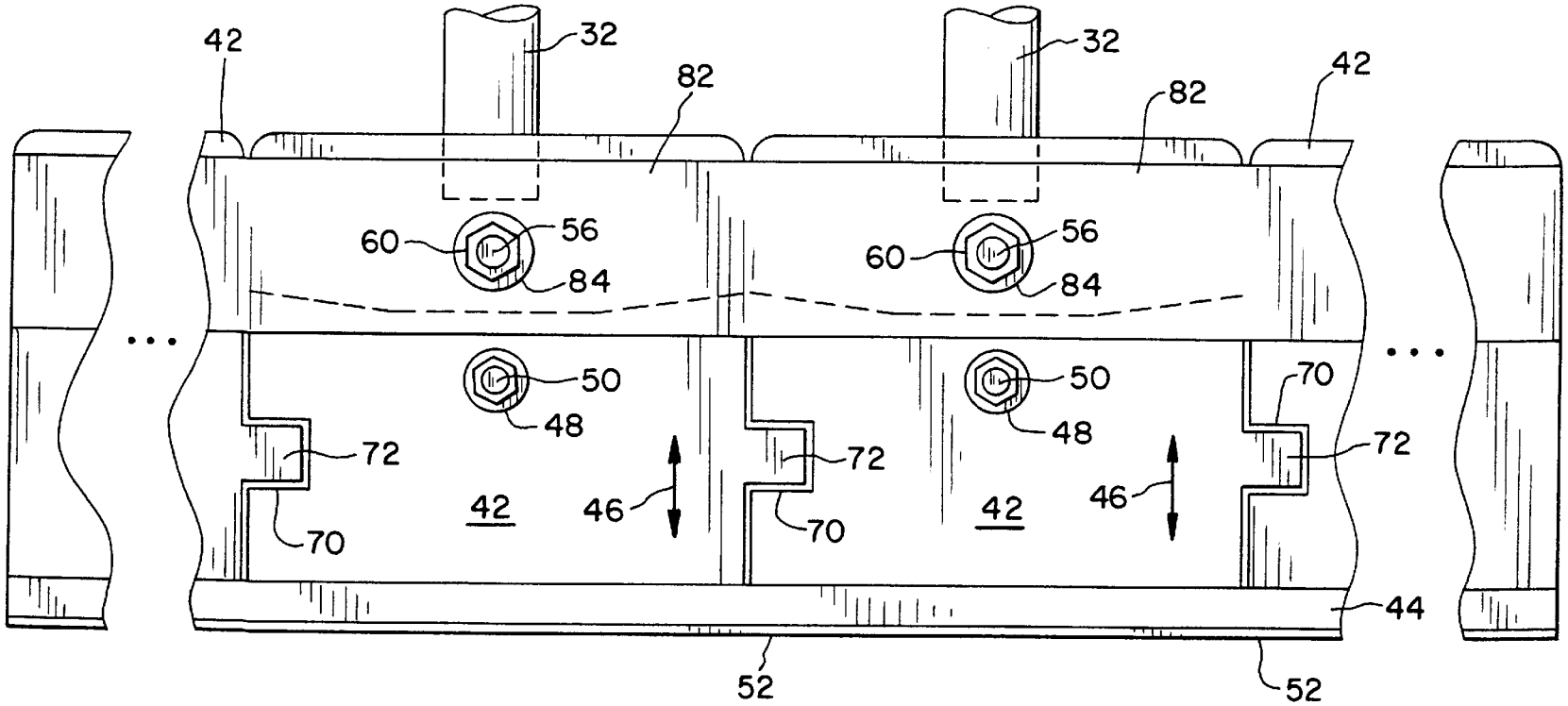
FIG. 6 is a fragmentary, plan view of another embodiment of a slice lip clamp assembly.

In the embodiment of slice lip clamp assembly 80 shown in FIGS. 4 and 5, a plurality of plates 82 are provided which respectively overlie and cover openings 54 and corresponding clamping plates 42. However, it is also to be understood that a single plate 82 may be provided which extends substantially across the working width of slice lip clamp assembly 80, as shown in FIG. 6. A single plate of course would include a plurality of spaced apart through holes 84 which align with corresponding bolts 56.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

I claim:

1. A headbox for a paper-making machine, said headbox including an inlet for receiving a fiber suspension, said headbox comprising:

an apron and an upper wall converging relative to each other and defining a machine wide discharge nozzle and an outlet therebetween, said discharge nozzle terminating at said outlet;

a slice lip carried by said upper wall, said slice lip positioned at said outlet and including a working edge defining an outlet gap with said apron, said slice lip being slidably movable a travel distance in directions toward and away from said outlet gap, and a slice lip clamp assembly connected to said upper wall and having a width, said slice lip clamp assembly engaging said slice lip and biasing said slice lip against said upper wall, said slice lip clamp assembly including:

a plurality of clamping plates, each said clamping plate having an opening with an inside diameter, each said clamping plate also including an aperture;

a single, continuous plate extending substantially across said width of said slice lip clamp assembly and over each said opening of said clamping plates, said plate having a plurality of through holes;

a plurality of fasteners, each said fastener having an outside diameter, said inside diameter of each said opening of said clamping plates being larger than said outside diameter of each said fastener by an amount which is dependent upon said travel distance, a number of through holes of said single plate corresponding to a number of said fasteners, each said fastener extending through a corresponding said through hole and corresponding said opening and being attached to said upper wall; and a plurality of bolts, each said bolt extending through a corresponding said aperture of a corresponding said clamping plate and attaching said corresponding clamping plate to said slice lip.

2. The headbox of claim 1, further comprising a plurality of spindles, each said spindle attached to a corresponding one of said clamping plates and defining a means for moving said slice lip in said directions toward and away from said outlet gap.

3. The headbox of claim 1, wherein each said clamping plate includes at least one travel limiting element which limits said travel distance of said slice lip in said directions toward and away from said outlet gap.

4. The headbox of claim 1, wherein said upper wall comprises a beam attached to an upper flow guide wall, each said clamping plate being connected to said beam.

5. The headbox of claim 1, wherein each said clamping plate includes a slot that opens towards said slice lip, said slots being substantially aligned in a direction substantially parallel to said outlet gap, said headbox further comprising a loading tube received within at least one of said slots and at least indirectly engaging said slice lip, said loading tube having an inlet configured for connection with a source of pressurized fluid.

6. The headbox of claim 1, further comprising a pivotable cover overlying at least a portion of at least one of said clamping plates.

7. A headbox for a paper-making machine, said headbox including an inlet for receiving a fiber suspension, said headbox comprising:

an apron and an upper wall converging relative to each other and defining a machine wide discharge nozzle and an outlet therebetween, said discharge nozzle terminating at said outlet; a slice lip carried by said upper wall, said slice lip positioned at said outlet and including a working edge defining an outlet gap with said apron, said slice lip being slidably movable a travel distance in directions toward and away from said outlet gap; and a slice lip clamp assembly connected to said upper wall, said slice lip clamp assembly engaging said slice lip and biasing said slice lip against said upper wall, said slice lip clamp assembly including:

a plurality of clamping plates, each said clamping plate including two travel limiting elements respectively disposed on opposing side edges of said corresponding clamping plate, each said travel limiting element comprising one of a projection and a recess wherein a notch of one clamping plate mates with a recess of an adjacent clamping plate, each said travel limiting element limiting said travel distance of said slice lip in said directions toward and away from said outlet gap, each said clamping plate having at least one opening with an inside diameter;

at least one fastener having an outside diameter, said inside diameter of each said opening of said clamping plates being larger than said outside diameter of each said fastener by an amount which is dependent upon said travel distance; and at least one keeper device extending over each said opening of said clamping plates, said at least one keeper device positioned over each said opening and having a number of through holes corresponding to a number of said fasteners, each said fastener extending through a corresponding said through hole and corresponding said opening and being attached to said upper wall.

8. The headbox of claim 17, wherein said at least one keeper device comprises a plurality of axially compressible washers, each said washer being associated with and covering a corresponding said opening in a corresponding said clamping plate.

9. A headbox for a paper-making machine, said headbox including an inlet for receiving a fiber suspension, said headbox comprising:

an apron and an upper wall converging relative to each other and defining a machine wide discharge nozzle and an outlet therebetween, said discharge nozzle terminating at said outlet;

a slice lip carried by said upper wall, said slice lip positioned at said outlet and including a working edge defining, an outlet gap with said apron, said slice lip being slidably movable a travel distance in directions toward and away from said outlet gap; and a slice lip clamp assembly connected to said upper wall, said slice lip clamp assembly engaging said slice lip and biasing said slice lip against said upper wall, said slice lip clamp assembly including:

a plurality of clamping plates, each said clamping plate including at least one travel limiting element which limits said travel distance of said slice lip in said directions toward and away from said outlet gap, each said clamping plate having at least one opening with an inside diameter;

at least one fastener having an outside diameter, said inside diameter of each said opening being larger than said outside diameter of each said fastener by a distance which is larger than said travel distance; and at least one keeper device extending over each said opening of said clamping plates, said at least one keeper device positioned over each said opening and having a number of through holes corresponding to a number of said fasteners, each said fastener extending through a corresponding said through hole and corresponding said opening and being attached to said upper wall.

* * * * *

UNITED STATES PATENT AND TRADEMARK OFFICE

CERTIFICATE OF CORRECTION

PATENT NO. : 6,068,736
DATED : May 30, 2000
INVENTOR(S) : Edwin X. Graf

It is certified that error appears in the above-identified patent and that said Letters Patent is hereby corrected as shown below:

COLUMN 6

Line 22, delete "17" and insert --7--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*